US006523609B1

(12) United States Patent
Miszewski

(10) Patent No.: US 6,523,609 B1
(45) Date of Patent: Feb. 25, 2003

(54) BOREHOLE PRESSURE GAUGE

(75) Inventor: Antoni Miszewski, Budleigh Salterton (GB)

(73) Assignee: Antech Limited, Exeter (GB)

( * ) Notice: Subject to any disclaimer, the term of this patent is extended or adjusted under 35 U.S.C. 154(b) by 0 days.

(21) Appl. No.: 09/656,209

(22) Filed: Sep. 6, 2000

(30) Foreign Application Priority Data

Sep. 7, 1999 (GB) ..... 9921136

(51) Int. Cl.[7] ..... E21B 47/00

(52) U.S. Cl. ..... 166/66; 166/250.07; 166/250.11; 175/50

(58) Field of Search ..... 166/250.01, 250.07, 166/205.11, 66; 175/40, 48, 50, 320

(56) References Cited

U.S. PATENT DOCUMENTS 4,628,995 A 12/1986 Young et al.
4,735,264 A 4/1988 Burris, II et al.
5,320,169 A 6/1994 Delatorre
6,012,537 A * 1/2000 Rountree et al. ..... 175/40

FOREIGN PATENT DOCUMENTS

WO 87/02095 4/1987
WO 95/16849 6/1995

* cited by examiner

*Primary Examiner*—David Bagnell
*Assistant Examiner*—Jennifer R. Dougherty
(74) *Attorney, Agent, or Firm*—Herbert Dubno; Andrew Wilford

(57) ABSTRACT

A gauge carrier comprises a main body capable of incorporation into a suitable drill string, and a separate instrument housing including a gauge, the instrument housing being securable to the main body. The main body includes a handling region suitable for being handled by rig tongs, such that the instrument housing may be attached substantially along that handling region subsequently to its being handled. The handling region is located substantially centrally along the length of the main body. The main body includes at least one protective region having a larger cross section than the majority of the main body.

8 Claims, 4 Drawing Sheets

BOREHOLE PRESSURE GAUGE

FIELD OF THE INVENTION

This invention relates to carrier assemblies, that is, assemblies for carrying instrumentation down boreholes and the like.

BACKGROUND OF THE INVENTION

Pressure-gauge carriers are often incorporated into drill strings so that the pressure within the drill string may be monitored. A conventional pressure-gauge carrier is generally tubular, having a bore similar to that of the drill string.

Figure 1:
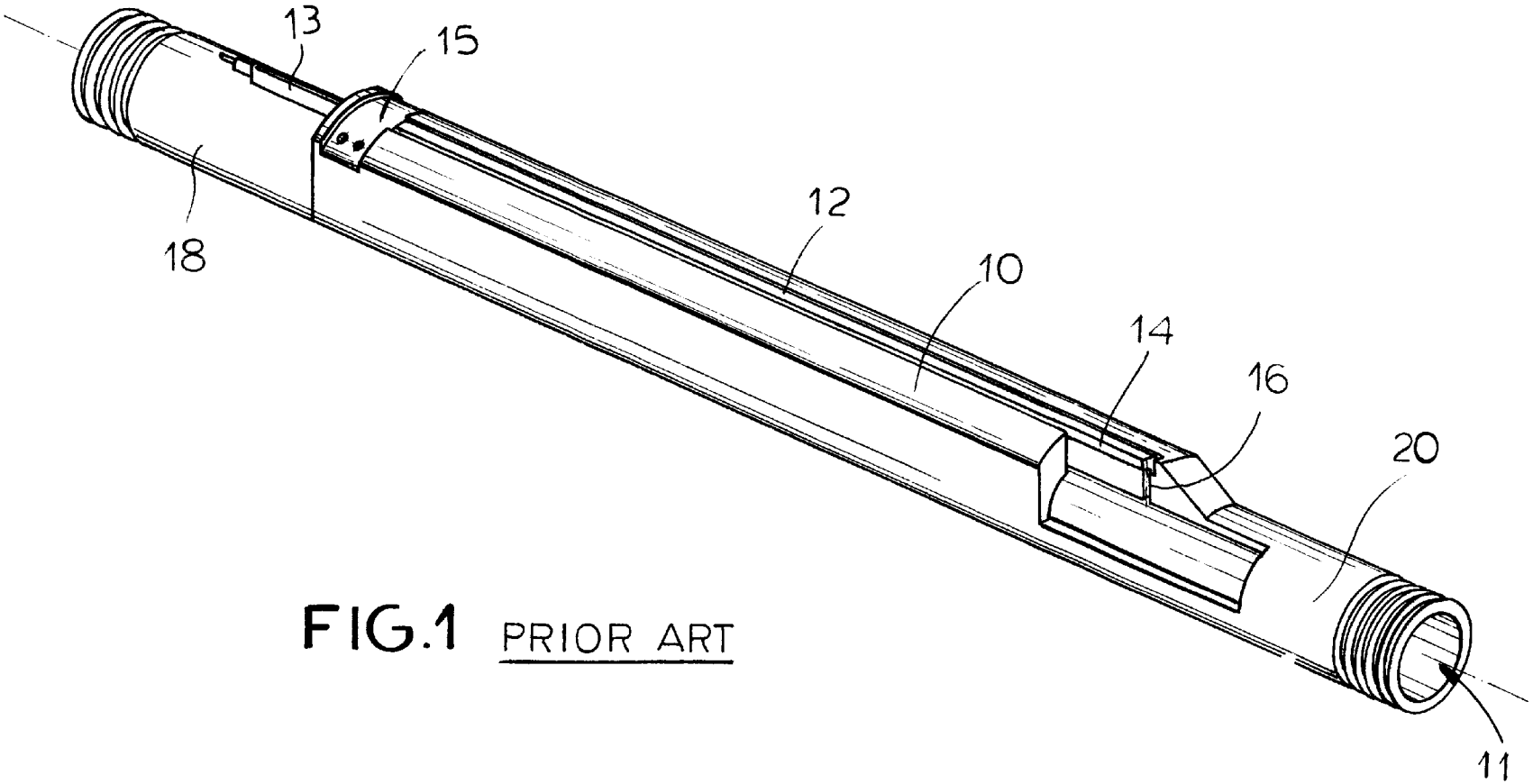
FIG.1 PRIOR ART
FIG. 1 is a prior-art pressure-gauge carrier in perspective view with a cutaway portion.

A known way of making such a pressure-gauge carrier is to machine the shape from a solid bar of metal. Such a gauge is shown in FIG. 1. An inner bore 11 corresponding to the drill string bore is drilled axially through it.

The bar is progressively machined at each end region to produce a central saddle 10 (that is, central when considering the pressure-gauge carrier lengthways), the outer boundary of the cross section of the saddle being defined by a lower curve and an upper curve, joined by two flat sides opposite and parallel to each other.

The two curves have a radius of curvature limited by the well casing. The axial bore 11 runs close to the lower curve, so that the thickness between the bore 11 and the lower curved surface corresponds approximately to the wall thickness of the drill string.

At either end of this central saddle 10, the pressure-gauge carrier extends axially as tubules 18 and 20, the end regions of the central saddle 10 being chamfered down to meet the diameter of the tubes 18 and 20 which have the same thickness as the thickness between the bore 11 and the lower curved surface of the central saddle 10. At each end of the pressure-gauge carrier, the outer surface of the device is threaded to fit with a drill pipe.

An axial groove 12 is machined from the upper curve of the saddle 10, the depth of the groove 12, considered in cross section, descending radially towards the center of the axial bore 11.

The pressure gauge 14, comprising a pressure-gauge sensor and its associated electronics, is arranged in a generally linear fashion. The pressure gauge is encased in a sheath to protect the components from the hostile borehole environment. The electronics thus sheathed are laid in the groove 12 in the saddle 10, the length of the groove 12 being such that the electronics run its full length. The pressure gauge sensor is situated at the end of the line of electronics (that is, the linear arrangement of circuitry associated with the pressure-gauge sensor), at the closed end of the groove 12. A channel 16 radially communicates between the axial bore 11 and the groove 12 at the closed end.

At the one end of the groove 12 the electronics and sheath terminates in a connector which is attached to a cable 13 that supplies the pressure gauge 14 with any power or commands it needs, and allows the transmission of data back to the surface. Somewhat short of this end of the groove 12, a plate 15 is clamped over the groove 12 to secure the pressure gauge 14. The central saddle 10 may be formed with a recess to accommodate the plate flush with its surface.

To incorporate the pressure-gauge carrier into the drill string, rig tongs grip the tubes 18 and 20 of the pressure-gauge carrier, and then carry the pressure-gauge carrier to the drill string, and introduce one end of the pressure-gauge carrier into the open end of the drill pipe at the top end of the drill string. The pressure-gauge carrier is rotated by the rig tongs so that the pressure-gauge carrier and the drill pipe are securely joined by their respective threads. The rig tongs are designed to grip a standard circumference (corresponding to the diameter of the drill pipe sections) with the required force.

The tubes 18 and 20 of the pressure gauge provide regions of standard circumference on the pressure gauge which can withstand the grip of the rig tongs.

The pressure-gauge carrier is an expensive piece of equipment. It involves a lot of machining from the original solid block of metal.

OBJECTS OF THE INVENTION

It is an object of the present invention to provide a pressure-gauge carrier which is economic to manufacture, which has good mechanical properties, and which is convenient to install.

SUMMARY OF THE INVENTION

According to one aspect of the invention there is provided a gauge carrier comprising a main body capable of incorporation into a suitable drill string, and a separate instrument housing including a gauge, the instrument housing being securable to the main body, and the main body including a handling region suitable for being handled by rig tongs and the like. The instrument housing is attached substantially along that handling region subsequently to its being handled, that is after the body is mounted on the drill string.

Preferably the handling region is located substantially centrally along the length of the main body. In addition the main body includes at least one protective region having a larger cross section than the majority of the main body, and preferably two flanking the handling region. Preferably the cross section of the protective region or regions correspond to the thickness of the instrument housing.

According to another aspect of the present invention, there is provided a method of incorporating a gauge carrier as herein defined into a drill string comprising the steps of:

joining an end of the main body to a drill pipe section, and thereafter attaching the instrument housing to the main body.

According to a further aspect of the present invention, there is provided a gauge carrier capable of incorporation into a suitable drill string including a gauge whose components are generally arranged in series, the gauge being housed in at least two substantially parallel chambers, and the gauge including a 180° bend in its arrangement. Preferably the chambers are axial bores.

According to a still further aspect of the present invention, there is provided a main body, an instrument housing, or a gauge as herein defined.

DESCRIPTION OF THE PREFERRED EMBODIMENT

Figure 2:
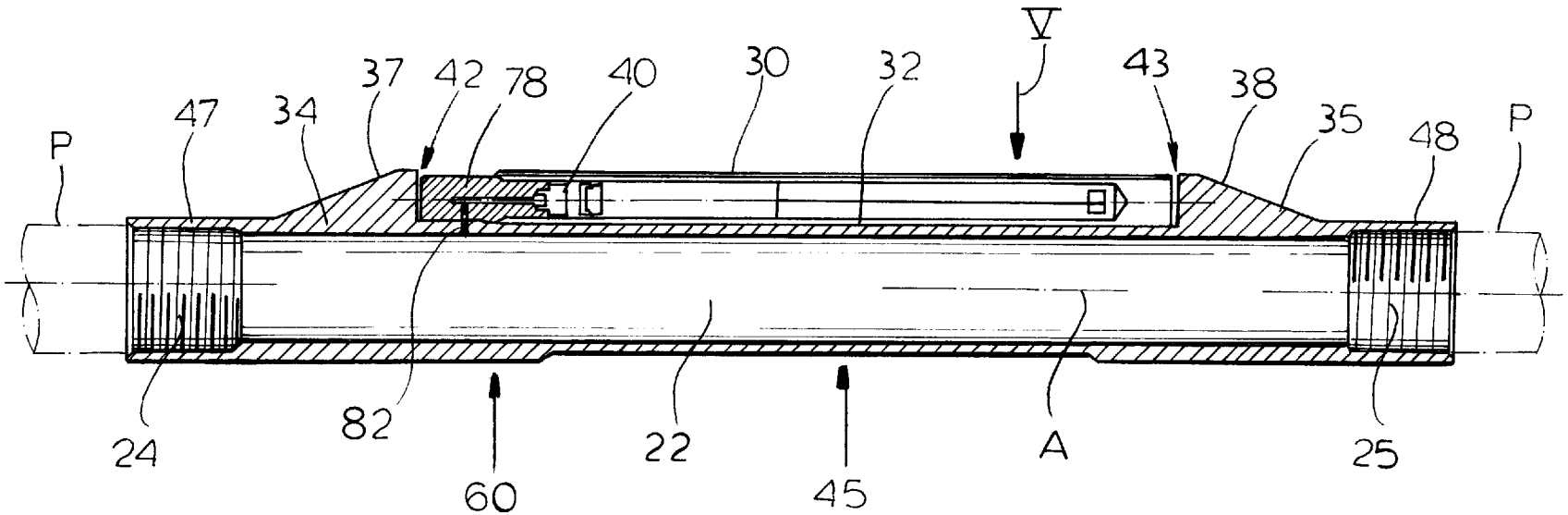
FIG. 2 is a longitudinal section of a preferred embodiment of a pressure-gauge carrier.
Figure 3:
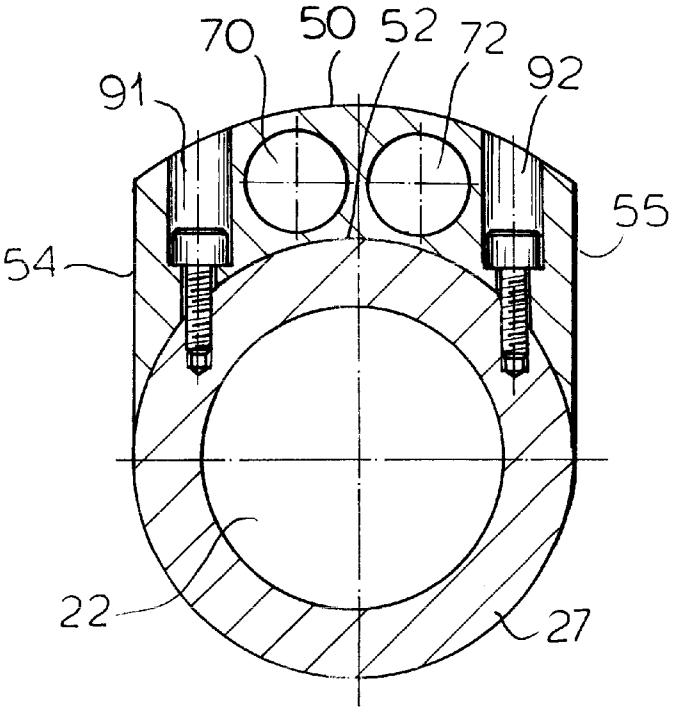
FIG. 3 is the instrument housing and narrowed region of the pressure-gauge carrier in cross section.
Figure 4:
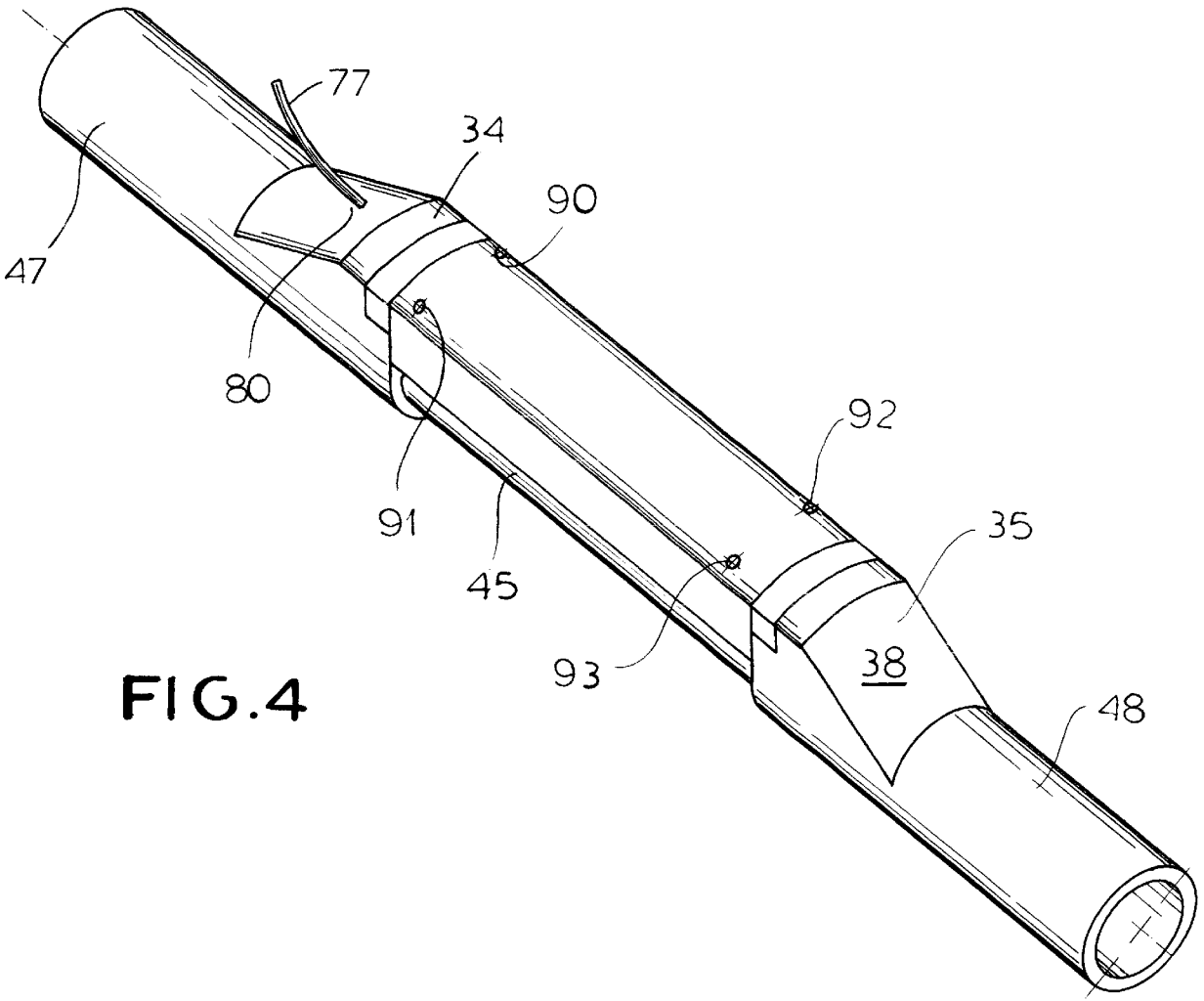
FIG. 4 is a perspective view of the pressure-gauge carrier.

Referring to FIGS. 2 to 4, the pressure-gauge carrier embodying the present invention comprises a main body 60 including a narrowed handling region 45, an instrument housing 30, and a pressure gauge 40.

Considered in cross section, the main body 60 is generally tubular, having a circular bore 22, and an generally cylindrical outer surface which is of generally similar diameter to the production tubing P with which it is intended to be joined. Internal screwthreads 24 and 25 are provided on the inner surfaces of the bore 22 corresponding to the thread on the male ends of the drill pipes 6 with which the carrier is to be attached.

Somewhat in from each end, the main body 60 widens to form two protective shoulders 34 and 35. At the shoulders' greatest extent, the cross section comprises the lower curve of the main body 60, two parallel sides, and an upper curve, which may, as shown here, have a greater radius of curvature than the curvature of the outer diameter of the tubular parts of the main body 60. The shoulders 34 and 35 have a chamfered flat surfaces 37 and 38 extending down to its respective end of the main body 60. The shoulders 34 and 35 then extend a short distance along the length of the main body 60, before ending with respective flat surfaces 42 and 43 perpendicular to the axis A of the main body 60.

The outer diameter of some or all the region between the faces 42 and 43 of the shoulders 34 and 35 may narrow somewhat as shown in the drawing. The diameter over this narrowed region 45 is smaller than that of the rest of the main body 60, so that the curvature of at this region 45 is more similar to the outer curvature of the drill pipe P. In this way, the region 45 is better adapted to being gripped by rig tongs as described below in more detail.

To aid introduction of the drill pipe ends into the main body 60, one or both ends of the main body 60 may extend outward in the form of tubular portions 47 and 48 whose wall thickness tapers somewhat, as shown in the drawing. As the tubular portions 47 and 48 are not necessary for the handling of the main body 60 by rig tongs, they need not be so long as in the case of the prior-art pressure-gauge carrier. Such tubular portions 47 and 48 could even be externally threaded to be accepted in a male fashion by female drill pipe sections, or indeed the main body 60 could have one male connecting end and one female connecting end.

An instrument housing 30 sits on a surface 32 of the main body 60 between the two shoulders 34 and 35. Referring to FIG. 3, the instrument housing 30 has a uniform cross section having a curved base face 52 which rest upon the outer surface 32 of the narrowed region 45 of the main body 60, two flat parallel sides 54 and 55, and an upper curved surface 50. The radius of curvature of this upper surface 50 is similar to that of the upper curved surfaces of the shoulder 34 and 35. When placed on top of the main body 60 between the shoulders 34 and 35, the instrument housing's upper curved surface 50 and two sides 54 and 55 lie inside or at least flush with the shoulders' upper curved surfaces and sides. The instrument housing 30 is therefore hidden behind the shoulders 34 and 35 when the carrier is viewed end on, so that the shoulders 34 and 35 protect the instrument housing 30 as the drill string advances through the borehole.

The instrument housing 30 also includes two axial bores 70 and 72 running side by side in the instrument housing 30, each an equal distance from the top surface 32 of the main body 60. These bores 70 and 72 are drilled out along the entire length of the instrument housing 30, and at one end of the instrument housing 30, the wall between the bores 70 and 72 is removed so that they communicate.

The instrument housing 30 is fitted in the region between the shoulders 34 and 35 and fastened to the main body 60, for example by four screws 94, 95, 96, and 97 at each corner 90, 91, 92, and 93. The instrument housing 30 is somewhat shorter than the distance between the opposing faces 42 and 43 of the shoulders 34 and 35, so that there is enough room to fit a cable connector to a row 41 of electronic components including the pressure sensor 40. Fitting the row 41 of electronic components in a linear arrangement is very convenient, first as circular bores are easier to form than other shapes, and second because the electronic components of various instruments are usually supplied in a standard linear form to enable interchangeability between instruments and their carriers.

Figure 5:
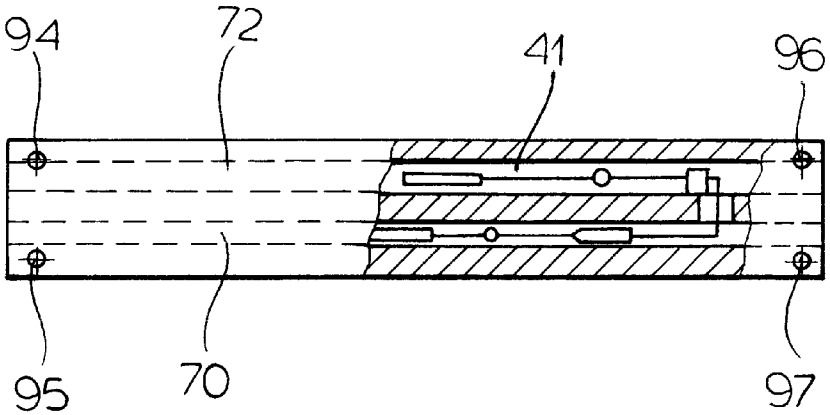
FIG. 5 is a partly broken-away view taken in the direction of arrow V of the instrument housing.

The pressure gauge's row 41 of electronic components is threaded through the first bore 70, turned back on itself and then threaded through the second bore 72, so that the row 41 of electronic components doubles back at the communicating region of the instrument holder where a wall between the bores 70 and 72 has been removed as shown in FIG. 5. At this end (hereinafter termed the switch-back end) of the instrument holder 30, the axial bores 70 and 72 are sealed so that they are no longer open to the outside.

At one end of the row 41 of electronic components, (at the end of the instrument housing 30 opposite the switch-back end and hereinafter termed the connector end) a connector (not here visible) is detachably attached. It is connected with a cable 77 that supplies any necessary power to the pressure gauge 40, and carries the data that the gauge collects back to the surface. The socket which accepts the connector fits firmly in one of the axial bores 70 and 72 at the connector end of the instrument housing 30, sealing the aperture. The shoulder 34 at the connector end includes a hole 80 to allow the cable 77 to pass through.

The row of electronic components also ends with a plug 78 at the connector end of the instrument housing 30, extending somewhat through the other aperture. This plug 78 seals the aperture, so that the chamber containing the electronic components is completely sealed off from the outside environment. A small channel 82 connects the main body's bore, via the plug 78, to the pressure gauge sensor 40.

In order to install the pressure-gauge carrier, the main body 60 (without the instrument housing 30 attached) is picked up by rig tongs, which grip the main body 60 at the narrow region 45 between the two shoulders 34 and 35, and place the main body 60 upon a drill pipe P so that a free end of the drill pipe 10 is inserted into the bore of the main body 60. The rig tongs then rotate the main body 60 so that it is securely joined to the drill pipe P. Once securely joined, the rig tongs are removed from the main body 60.

The instrument housing 30, with the pressure gauge 40 installed, is now attached to the main body 60. The cable 77 is threaded through the hole 80 in the uppermost shoulder 34, and joined by its connector to the pressure gauge 40.

The next drill pipe section P is introduced into the free end of the pressure-gauge carrier body 60 and tightened in the conventional manner using rig tongs. If desired the fitting of the instrument housing 30 may be postponed until subsequent drill pipe has been fitted.

Since the instrument housing 30 and pressure gauge 40 are only fitted after the main body 60 is attached to the pipes P of the drill string, the danger of the pressure gauge 40 being damaged is greatly reduced.

The main body 60 may also be handled by the region 45 between the shoulders 34 and 35 prior to being added to the drill string, for example in the workshop, and when being brought to the rig.

The pressure-gauge carrier body 60 may be a much shorter length, and therefore require far less machining, than a conventional pressure-gauge carrier. There are several reasons for this. Since the pressure gauge 40 is not fitted to the main body 60 until after the main body 60 has been installed in the drill string, the rig tongs may grip the main body 60 at any point between the shoulders 34 and 35. The tubular portions extending from the prior art pressure-gauge carrier, by which the pressure-gauge carrier is carried, are thus not necessary. For this reason the main body 60 ideally fits in a female fashion to introduced drill pipe sections.

A length saving also results from turning the row 41 of electronic components back upon itself. The instrument housing 30 is about half the length of the electronic components disposed along the groove of the prior-art pressure-gauge carrier.

The instrument housing 30 is stronger than known instrument housings of the same diameter, as the double bore ensures a greater wall thickness between the bores 70 and 72 and the upper curve 50 than would be the case for a single bore.

These savings in length allow a smaller block of metal to be used to form the pressure-gauge carrier body 60, and consequently much less machining is required. This represents a considerable cost saving over machining a longer pressure-gauge carrier.

The pressure gauge 40 itself is much less likely to be damaged, as it is fitted only after the main body 60 has been incorporated into the drill string. The pressure gauge 40 is also protected to a greater extent by the greater structural strength of the instrument housing 30 over the corresponding portion of the prior-art pressure-gauge carrier. By sacrificing some of this additional structural strength, the pressure-gauge carrier body 60 could be made to a smaller outer diameter.

Specific features disclosed herein could be combined with other features of prior-art gauge carriers in many permutations. For example, the parallel bores 70 and 72 of the instrument housing 30 could be bored directly into an integral pressure-gauge carrier of the prior-art type. Rather than bores, the gauge 40 could be housed in two parallel channels machined out of the pressure-gauge carrier body 60. Those skilled in the art will realize that the principles disclosed herein could be applied to any similar instrument carriers with the necessary adaptations, and it is intended that such alternatives are included within the scope of the invention, the scope of the invention being limited only by the following claims.

What is claimed is:

1. In combination with a drill string comprised of pipe of a predetermined size and shape, a borehole pressure gauge comprising:

a main body extending along an axis and formed with ends matable axially with the pipe of the drill string, a central handling region between the ends and having a size and shape generally equal to those of the pipe, whereby rig tongs can fit with the handling region, at least one radially projecting protective formation between one of the ends and the handling region, and an axially throughgoing passage interconnecting pipes connected to its ends;

an instrument housing snugly fittable to the handling region;

a pressure sensor in the instrument housing; and means releasably securing the housing to the handling region.

2. The borehole pressure gauge defined in claim 1 wherein the central handling region and pipes are substantially cylindrical.

3. The borehole pressure gauge defined in claim 1 wherein the main body has two such protective formations each between a respective one of the ends and the central handling region, the instrument housing being snugly fittable between the protective formations.

4. The borehole pressure gauge defined in claim 3 wherein the protective formations have side and outer surfaces and the instrument housing has side and outer surfaces generally axially aligned with the formation side and outer surfaces, whereby the instrument housing does not project radially past the protective formations.

5. The borehole pressure gauge defined in claim 1 wherein the instrument housing includes an elongated chamber holding the sensor.

6. The borehole pressure gauge defined in claim 5 wherein the chamber is U-shaped and the gauge further comprises other electrical components connected in a U-shaped row with the sensor and mounted in the U-shaped chamber.

7. The borehole pressure gauge defined in claim 1 wherein the means includes screws engaged generally radially through the instrument housing into the main body.

8. In combination with a drill string comprised of pipe of a predetermined size and shape, a borehole pressure gauge comprising:

a main body extending along an axis and formed with ends matable axially with the pipe of the drill string, a central handling region between the ends and having a size and shape generally equal to those of the pipe, whereby rig tongs can fit with the handling region, at least one radially projecting protective formation between one of the ends and the handling region;

an instrument housing snugly fittable to the handling region and including an elongated U-shaped chamber;

a pressure sensor in the chamber of the instrument housing;

other electrical components connected in a U-shaped row with the sensor and mounted in the U-shaped chamber; and means releasably securing the housing to the handling region.

* * * * *